US009260824B1

(12) United States Patent
Aciu

(10) Patent No.: US 9,260,824 B1
(45) Date of Patent: Feb. 16, 2016

(54) PACKAGES AND METHODS FOR PACKAGING AND FOR LAYING PAVING ELEMENTS

(71) Applicant: Cristian Aciu, Wayne, NJ (US)

(72) Inventor: Cristian Aciu, Wayne, NJ (US)

( * ) Notice: Subject to any disclaimer, the term of this patent is extended or adjusted under 35 U.S.C. 154(b) by 0 days.

(21) Appl. No.: 14/574,537

(22) Filed: Dec. 18, 2014

Related U.S. Application Data

(63) Continuation of application No. 14/483,241, filed on Sep. 11, 2014.

(51) Int. Cl.
*E01C 9/00* (2006.01)
*E01C 15/00* (2006.01)
*E01C 11/16* (2006.01)

(52) U.S. Cl.
CPC ..... *E01C 15/00* (2013.01); *E01C 9/004* (2013.01); *E01C 11/16* (2013.01)

(58) Field of Classification Search
CPC ..... E01C 19/522; E01C 9/004; E01C 11/16; E01C 15/00
USPC ..... 404/34–40, 43, 73, 75, 86, 99–101, 404/134; 405/258.1
See application file for complete search history.

(56) References Cited

U.S. PATENT DOCUMENTS

| | | | | |
|---|---|---|---|---|
| 1,592,591 | A | 7/1926 | Amele | |
| 1,952,508 | A * | 3/1934 | McConnaughay | 404/73 |
| 3,568,579 | A | 3/1971 | Hoad et al. | |
| 4,681,482 | A | 7/1987 | Arciszewski et al. | |
| 4,963,054 | A | 10/1990 | Hayashi | |
| 5,342,141 | A * | 8/1994 | Close | 404/28 |
| 5,449,543 | A * | 9/1995 | Bach et al. | 428/117 |
| RE35,380 | E | 11/1996 | Rea | |
| 5,588,775 | A | 12/1996 | Hagenah | |
| 6,171,015 | B1 * | 1/2001 | Barth et al. | 404/34 |
| 6,267,531 | B1 | 7/2001 | Clarke | |
| 6,551,016 | B2 | 4/2003 | Guidon | |
| 6,575,660 | B1 * | 6/2003 | Davis et al. | 404/35 |
| 7,244,076 | B2 * | 7/2007 | Whitson | 404/73 |
| 2008/0276562 | A1 | 11/2008 | Stuchell | |
| 2009/0136296 | A1 | 5/2009 | Usdenski | |
| 2011/0239572 | A1 | 10/2011 | Calapkulu | |
| 2012/0020730 | A1 * | 1/2012 | Chow | B29C 45/0001 404/34 |
| 2013/0022397 | A1 * | 1/2013 | Ringus et al. | 404/47 |
| 2013/0086869 | A1 | 4/2013 | Couturier | |

* cited by examiner

*Primary Examiner* — Raymond W Addie

(57) ABSTRACT

A paving package has a spaced plurality of paving elements interconnected through a flexible connecting medium. The paving elements are wound into a roll. An outdoor surface destined to receive the paving elements is prepared by laying bedding material on the surface. The roll is brought near the surface and unwound to lay at least some of the paving elements in a predetermined region on the surface.

8 Claims, 10 Drawing Sheets

PACKAGES AND METHODS FOR PACKAGING AND FOR LAYING PAVING ELEMENTS

CROSS REFERENCES TO RELATED APPLICATIONS

This application is a continuation and claims the benefit of the U.S. patent application Ser. No. 14/483,241, filed Sep. 11, 2014.

BACKGROUND OF THE INVENTION

1. Field of the Invention

The present invention relates to apparatus and methods for paving, and in particular, to paving by laying down a plurality of discrete elements.

2. Description of Related Art

Paving outdoor surfaces requires relatively heavy materials that can withstand the elements outdoors. Consequently, conventional outdoor paving techniques require one to transport and lay many hundreds, if not thousands, of pounds of paving material, which becomes a serious logistical challenge.

Stones, bricks, and other masonry articles have been used to pave walkways, streets, patios, etc. Cobblestones are an early example. A more recent example is the use of paving bricks or pavers. As shown in FIG. 8, an earthen surface can be prepared by placing a layer of gravel 10 in a shallow excavation. Gravel layer 10 will be compacted in the usual fashion. The region to be paved is encompassed by border elements, in this case wooden beam 12, although in some cases the edge restraint may be a vertical plastic strip with a lower ledge (not shown) designed to slip under the paving bricks. Gravel layer 10 is covered with a layer of sand 14. Solid paving bricks P are laid atop sand layer 14 in a pleasing pattern, with some arranged transverse to the others. A gap is left between paving bricks P, which is filled with sand S that permits water drainage through layers 14 and 10 to the earth E below.

Laying paving bricks P is time-consuming since one must be careful to maintain a uniform gap between bricks, lay the bricks in a pattern that is pleasing, and in some cases choose a sequence of differently colored bricks to produce a pleasant appearance.

Known composite materials are used as a replacement for wood. These composites may include a plastic material with cellulosic filler such as wood flour, wood chips, comminuted coconut or peanut shells, etc. The plastic may be a thermoplastic such as polyethylene, polyvinyl chloride, polypropylene, ABS, or a mixture thereof. Such composite materials are commercially available as deck materials from Trex Company, Inc of Winchester, Va.; and as Timbertech™ products from Crane Plastics Company, L.P, of Columbus, Ohio. These types of composites are described in U.S. Pat. Nos. 2,041,217; 5,474,722; 5,851,469; 5,866,264; and 6,272,808, as well as US Patent Application Publication No. 2002/0066248.

The strength and durability of natural or synthetic rubber can be improved by a vulcanizing process. In some cases sulfur is dispersed or dissolved in the rubber and then heated to create cross-links between long-chain molecules in the rubber. The process can be made more efficient by using chemical accelerators to hasten the cross-linking.

See also U.S. Pat. Nos. 1,592,591; 3,568,579; 4,681,482; 4,963,054; 5,588,775; 6,267,531; 6,551,016; U.S. Reissue Pat. RE35,380; and US Patent Application Publication Nos. 2008/0276562; 2009/0136296; 2011/0239572; and 2013/0086869.

SUMMARY OF THE INVENTION

In accordance with the illustrative embodiments demonstrating features and advantages of the present invention, there is provided a method for laying a roll of spaced and interconnected paving elements. The method includes the step of preparing an outdoor surface by laying thereon bedding material. The method also includes the step of locating the roll at the surface. Another step is unwinding the roll to lay at least some of the paving elements in a predetermined region on the surface.

In accordance with another aspect of the invention, a method of packaging paving elements is provided. The method employs a connecting medium and includes the step of interconnecting the paving elements with the connecting medium. The method also includes the step of winding the paving elements into a roll.

In accordance with yet another aspect of the invention, a paving package is provided that includes a flexible connecting medium, and a spaced plurality of paving elements. The paving elements are interconnected through the connecting medium. The paving elements are wound into a roll.

By employing apparatus and methods of the foregoing type, paving elements can be easily laid. In one embodiment a composite material is molded into a rectangular paving element with underside hollow chambers on the underside. These paving elements can be interconnected to form a long runner that has one or many paving elements across the width of the runner. The paving elements are interconnected, typically along an edge or corner, to leave clearance between them that allows a degree of articulation between the elements, so they can be wound into a compact and easily transported roll. The use of composite materials and hollow chambers greatly reduces the weight of the paving elements and therefore the weight of the roll.

In one embodiment a connecting medium connects between the upper corners of adjacent paving elements. The connecting medium can be an elastomeric material that firmly adheres to the paving elements in some embodiments the connecting medium can be silicone, vulcanized rubber, or other materials that can connect the paving elements. In other embodiments flexible cords can be formed into a grid or mesh and attached to the underside of the paving elements. In one embodiment notches or grooves are formed on the underside of the paving elements to receive these flexible cords.

Installation is started by laying in a shallow excavation a gravel layer that is then compacted. The region to be paved can be encompassed by an ordinary edge restraint, which can be installed before or after the paving elements are laid. The gravel layer will be covered with a layer of sand.

A stretch of interconnected paving elements is then unwound from the roll and placed atop the layer of sand in the desired position. While on the roll, the tops of the paving elements face radially inward for the embodiment where the paving elements are connected at their upper edge by an elastomer. In that case the roll may be placed directly atop the layer of sand and unrolled, much like a carpet roll. For the embodiment where the paving elements are connected underneath, the tops of the paving elements face radially outward. This requires the installers to elevate the roll and carry it along the region to be paved, while simultaneously pulling paving elements off the roll and laying them down.

The paving elements that are needed for an installation can be severed from the roll by cutting the connecting medium (upper elastomer or lower grid). A highly customized installation can be achieved by trimming the individual paving elements as needed to fit the allotted space. Where the space to be paved is relatively wide, a second course can be laid by unwinding a strip from the roll and laying it alongside the first course.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
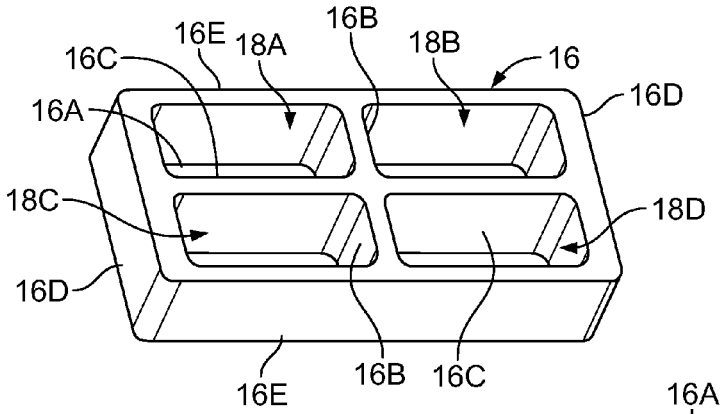
FIG. 1 is bottom perspective view of a paving element in accordance with principles of the present invention.
Figure 2:
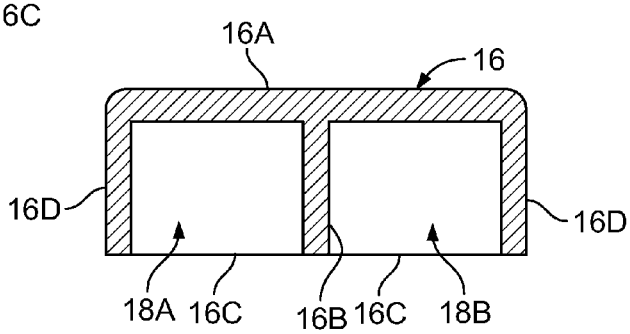
FIG. 2 is an elevational, cross-sectional view taken across one of the concavities of the element of FIG. 1.

Referring to FIGS. 1 and 2, paving element 16 is shown as a rectangular shell with a top slab 16A, a parallel pair of longitudinal walls 16E, and a parallel pair of end walls 16D. (The broad outside faces of walls 16D and 16E are referred to herein as side faces.) Internal wall 16C running along the longitudinal centerline of paving element 16, intersects and bisects transverse internal wall 16B. Intersecting walls 16C and 16D form on the underside of paving element 16 four open concavities 18A, 18B, 18C, and 18D (collectively concavities 18). Note, the cross-section of FIG. 2 is viewing outwardly from a longitudinal plane bisecting chambers 18A and 18B.

In this embodiment, paving element 16 has an overall length of 7⅝ inches (19.4 cm), an overall width of 3⅝ inches (9.2 cm), and an overall height of 2¼ inches (5.7 cm), although it will be appreciated that different dimensions may be used, depending upon the installation requirements or a user's preferences. Also, larger paving elements may have more concavities to accommodate the increased size without compromising structural strength. Walls 16A, 16B, 16C, 16D, and 16E each have a thickness of 0.35 inch (0.9 cm), although these walls can be thicker or thinner and the thickness may vary from wall to wall, depending upon the desired weight, strength, etc. Also, walls of nonuniform thickness are contemplated.

Furthermore, while four chambers 18 are illustrated, some embodiments may have a different number; for example, eight chambers. Also, chambers need not be the same size and shape and can, in general, be arranged in an n×m matrix, including a 1×n matrix. In addition, the matrix might not be orthogonal but may have staggered elements arranged along a diagonal. Also, the chambers need not need be rectangular, but can have an outline that is circular, oval, polygonal, etc. In addition, the chambers need not be uniform and may have walls that converge or diverge toward each other. Furthermore, in some cases the chambers may be closed with a lower slab. Moreover, in some embodiments the paving element may be a solid piece with no chambers.

In this embodiment paving element 16 is molded from composite materials, such as a thermoplastic material with a cellulosic filler. In alternative embodiments other materials may be employed such as other types of plastics, ceramics, concrete, cement, wood, carbon fibers, epoxies, refractory materials, metal, or stratified combinations of such materials.

The top of slab 16A has a brushed finish (i.e., a number of small parallel grooves), although in some cases the grooving will be deeper. In other embodiments this upper surface can be smooth, pebbled, finished with rectangular or cylindrical stubs, crowned, etc. In some cases the upper surface will be cladded with a slip-resistant material.

In some embodiments the paving element 16 can be formed from discrete elements that are fastened together by means of gluing, fusion, welding, discrete fasteners, etc. As an example, top 16A may be manufactured as an extruded slab that is cut into a number of appropriately sized elements. Also, walls 16B, 16C, 16D, and 16E may be extruded together and then cut to an appropriate length, and later attached to top 16A.

Also, while paving element 16 has the general outline of a rectangular prism with rounded vertical corners, embodiments are anticipated where this outline may be some other polygonal prism (e.g., a hexagonal prism). Other prismatic shapes are possible as well; for example, outlines where one or more of the side walls are curved convexly or concavely. Instead of a prismatic shape, some embodiments may have side walls that are pitched inwardly or outwardly (i.e., converging or diverging). Embodiments are contemplated where adjacent paving elements have opposing side walls that are pitched in a complementary fashion, i.e. an inwardly pitched side wall will face a neighboring, outwardly pitched side wall.

Figure 3:
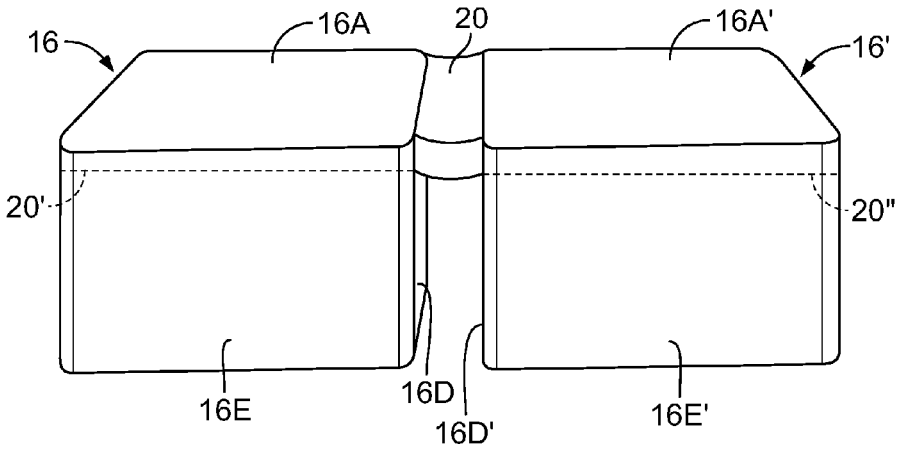
FIG. 3 is a perspective view of a pair of the paving elements of FIG. 1 shown interconnected by a connecting medium.

Referring to FIG. 3, previously mentioned paving element 16 is shown side-by-side with identical paving element 16'. Components of element 16' corresponding to components in element 16 will have the same reference numerals but marked with a prime (').

Connecting medium 20 is shown interconnecting the side faces of adjacent side walls 16D and 16D', along the upper edges of these side walls. Connecting medium 20 covers approximately the upper 15% of the side faces of side walls 16D and 16D', although a different percentage of coverage can be employed in other embodiments.

It will be understood that connecting medium 20 may extend on all four sides of the paving elements 16 and 16'; namely, the right, left, back, and front sides. In particular, connecting media 20' and 20" are shown in phantom along the front sides of paving elements 16 and 16', respectively, in order to connect them to other adjacent paving elements (not shown). Similar connecting media can be placed on the remaining sides of paving elements 16 and 16' to connect to other adjacent paving elements (also not shown). Consequently, connecting media 20 will be part of a grid connecting a plurality of paving element 16. It will be understood that terminal paving elements on the border of a group of elements need not have a connecting media on their outside faces.

Connecting element 20 may be an elastomeric material such as silicone or rubber that has the ability to adhere to the side faces of paving elements 16 and 16'. Connecting medium 20 may be laid as a bead between elements 16 and 16'. When rubber is used as the connecting medium 20 the rubber may be vulcanized in the conventional manner. Silicone will be allowed to cure in the normal manner.

In some embodiments the side faces of paving elements 16 and 16' may have holes, slots, or dovetail grooves for receiving and holding the material of the connecting medium 20. In such cases the connecting medium need not necessarily be adherent. In some cases top walls 16A and 16A' and may be discrete elements, in which case a rubber-like sheet (not shown) can be laid atop walls 16D, 16E, 16D', and 16E' before attaching top walls 16A and 16A'.

Figure 4A:
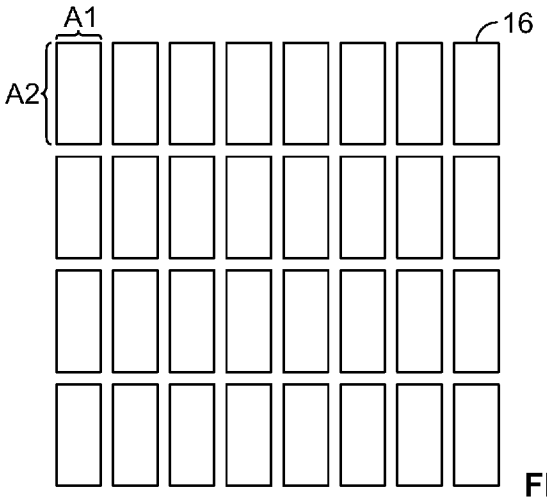
FIGS. 4A through 4J are plan views of ten different patterns for laying paving elements are the same as, or sized differently from, that shown in FIG. 1.

In this first embodiment paving elements 16 are arranged in the n×m matrix shown in FIG. 4A. It will be understood that the illustrated pattern is a section of a larger repeating pattern. The pattern is illustrated in this Figure with eight columns A1 and four rows A2, but a practical embodiment may have, for example, twelve columns A1 and forty nine rows A2.

The thirty two paving elements 16 of FIG. 4A are shown with a uniform element-to-element spacing of ⅜" (9.5 mm), although the spacing can be varied to adjust the attachment strength and the ability of paving elements to articulate and wind into a roll, as will be described presently it will be understood that spaces between paving elements 16 are spanned by the previously mentioned connecting medium 20 of FIG. 3.

Figure 5:
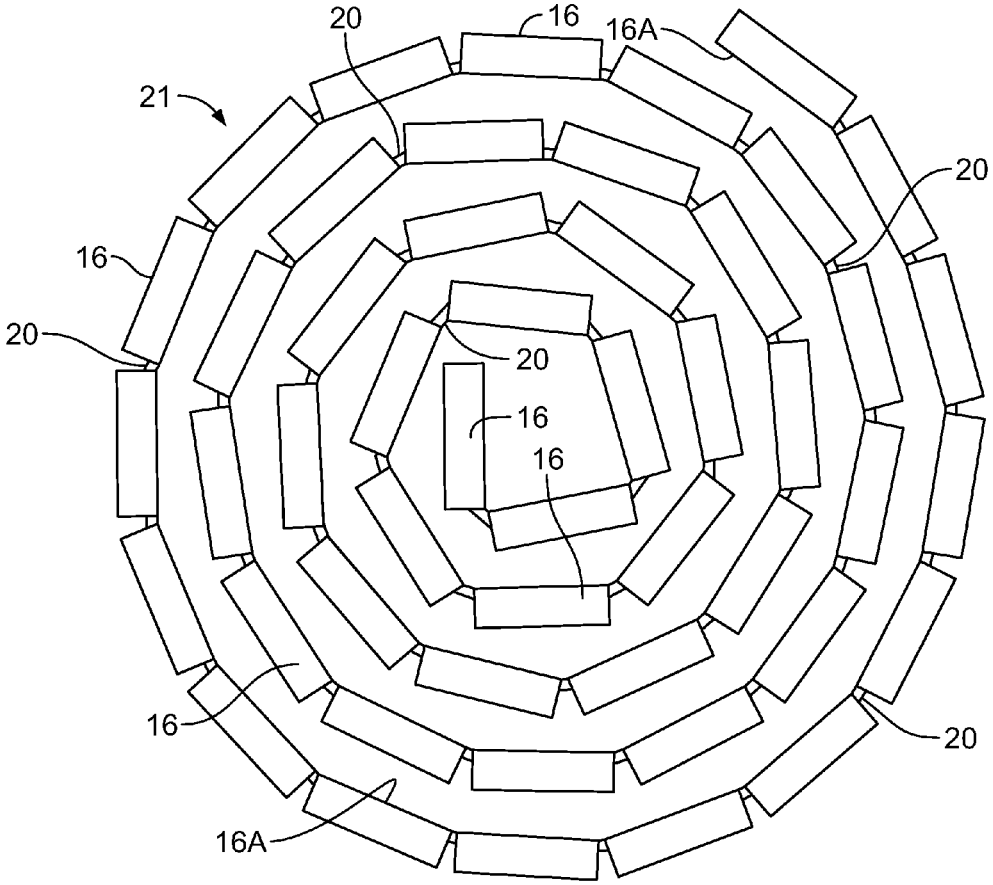
FIG. 5 is an axial view showing the paving elements interconnected with the connecting medium of FIG. 3 into the pattern of FIG. 4A, and wound into a roll.

The foregoing arrangement is formed into a long strip or runner that can be wound into a roll 21 as shown in FIG. 5. Roll 21 is also referred to herein as a paving package. As an alternative, a strip can be formed with six rows A2 and one hundred columns A1 (FIG. 4A). In that case the strip will be wound along a different, perpendicular axis.

It will be understood that in any event, the size of the strip can be varied depending upon the needs and preferences of the user and the requirements of the installation. Accordingly, different size rolls will be made available to purchasers. In particular smaller rolls (narrow and fewer turns) may be chosen to reduce overall weight and facilitate manual installation, while larger rolls may be more efficient for larger jobs. Also, rolls may be chosen to accommodate the region to be paved; that is, narrow rolls with just a few turns for small jobs, or wide rolls with many turns for bigger jobs. Also, the roll width can be chosen as a submultiple of the width of the region to be paved (e.g., a roll with a 3 foot (0.9 meter) width can be used for paving an area that is six feet (1.8 meters) wide by laying two courses).

Figure 4B:
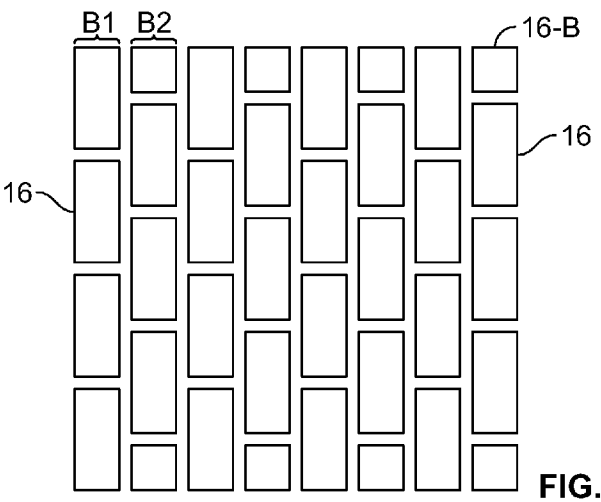

In FIG. 4B paving elements 16 are arranged in a number of alternating columns B1 and B2, with the elements of one column longitudinally shifted relative to the other column. Basically the gap between elements 16 of column B1 align with the longitudinal midpoint of paving elements 16 in column B2. As before, a practical embodiment will have perhaps eighty columns, each with about eight paving elements 16.

Because the paving elements 16 are staggered, this design avoids jaggedness at the sides of the strip by interleaving half-length paving elements 16-B at the ends of alternating columns. These elements 16-B are shown at the ends of columns B-2, but depending on the strip width, elements 16-B may be deployed at one end of column B1 and the opposite end of column B2. (Note the strip can start and end with either column B1 or B2.)

As before, connecting medium 20 of FIG. 3 will be attached between adjacent ones of the paving elements 16 and 16-B. Because of the staggering it will be difficult, if not impossible, to wind a strip whose length is parallel to columns B1 and B2.

Figure 4C:
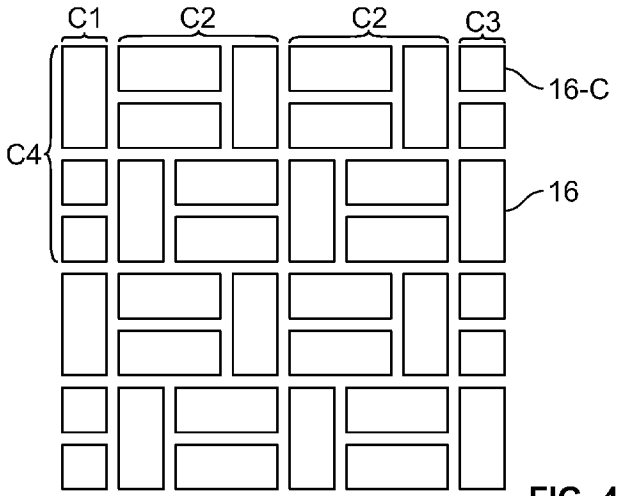

In FIG. 4C paving elements 16 are arranged in a repeating pattern containing six elements. In the upper half of the rectangular region defined by column C2, row C4, two parallel paving elements 16 are stacked side-by-side with their longitudinal axes running from right to left and are bordered on the right by a third paving element 16 having its longitudinal axis transverse to the other two. The other three paving elements 16 in the lower half of the pattern are the mirror image of those in the upper half. This Figure has a pair of columns C2, each with two groups of six paving elements 16, although practical embodiments will have a larger number of sextuples. For example, one embodiment may have three columns C2, each with 25 sextuples. As another example, one may have 34 columns C2, each with three sextuples.

Column C1 is optional and may be considered the remainder resulting from removing all but the right third of column C2. Likewise optional column C3 may be considered the result of removing all but the left third of column C2. This severing will divide the two parallel paving elements 16 of a sextuple to produce half elements 16-C. Since columns C1 and C3 represent different thirds, these columns appear longitudinally shifted relative to each other.

As before, connecting medium 20 of FIG. 3 will be attached between adjacent ones of the paving elements 16 and 16-C. It will be noted that each of the sextuples of columns C2 can articulate with respect any adjacent sextuple on any side. Thus, the arrangement of FIG. 4C can be extended in a direction either parallel or transverse to columns C2 and can still be wound into a roll similar to that shown in FIG. 5.

Figure 4D:
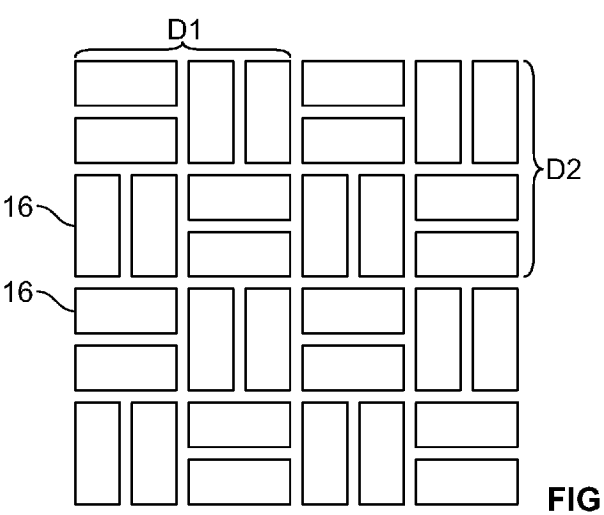

In FIG. 4D paving elements 16 are arranged in a repeating pattern containing eight elements. As shown in the rectangular region defined by column D1, row D2, two pairs of parallel paving elements 16, running left to right, are located in the upper left and lower right corners of the pattern. The other two corners of the pattern have two pairs of parallel paving elements 16 running transverse to the other four. This Figure has a four groups of eight, although practical embodiments will have a larger number of groups than that. For example, one embodiment may have three columns D1, each with 25 groups of eight.

It will be noticed that rotating the pattern of FIG. 4D 90° produces the same pattern. There is therefore no need to discuss extending the pattern in different orthogonal directions. It will also be noticed that one can divide column D1 or row D2 in half if one desires to change the size of the strip produced by this pattern. As before, connecting medium 20 of FIG. 3 will be attached between adjacent ones of the paving elements 16 so that columns D1 or rows D2 can be wound into a roll similar to that shown in FIG. 5.

Figure 4F:
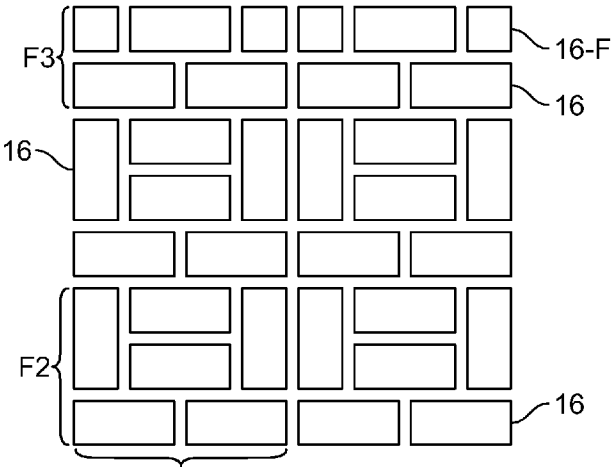
Figure 4E:
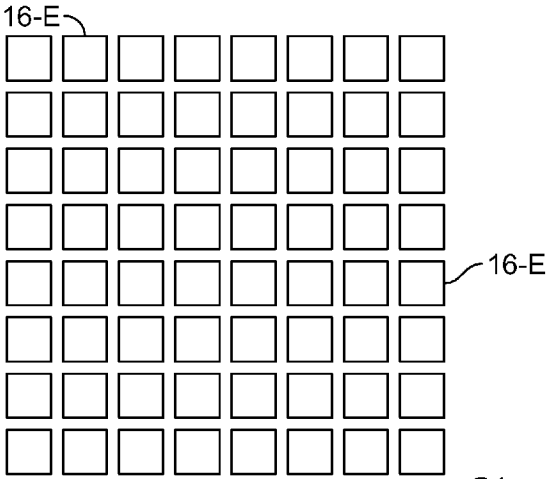

The embodiment of FIG. 4E has an 8×8 matrix of paving elements 16-E that are the same width but half the length of previously mentioned paving elements 16. As before, connecting medium 20 of FIG. 3 will be attached between adjacent ones of the paving elements 16E and the pattern can be expanded into a strip that can of be wound into a roll similar to that shown in FIG. 5.

In FIG. 4F paving elements 16 are arranged in a repeating pattern containing six elements. As shown in the rectangular region defined by column F1, row F2, a pair of parallel paving elements 16, running left to right, are stacked side-by-side and are bordered on the right and left by a third and fourth paving element 16 that have their longitudinal axes transverse to the pair. The remaining two paving elements 16 are located below the other four and are positioned end-to-end with their longitudinal axes aligned. This Figure has four sextuples, although practical embodiments will have a larger number of sextuples than that. For example, one embodiment may have three columns F1, each with 34 groups of six. Alternatively, another embodiment may have three rows F2 each with 25 columns F1. Optional row F3 may be considered the remainder after removing the top third of row F2, with the resulting halved paving elements being identified as elements 16-F.

As before, connecting medium 20 of FIG. 3 will be attached between adjacent ones of the paving elements 16 so that columns F1 or rows F2 can be wound into a roll similar to that shown in FIG. 5.

Figure 4G:
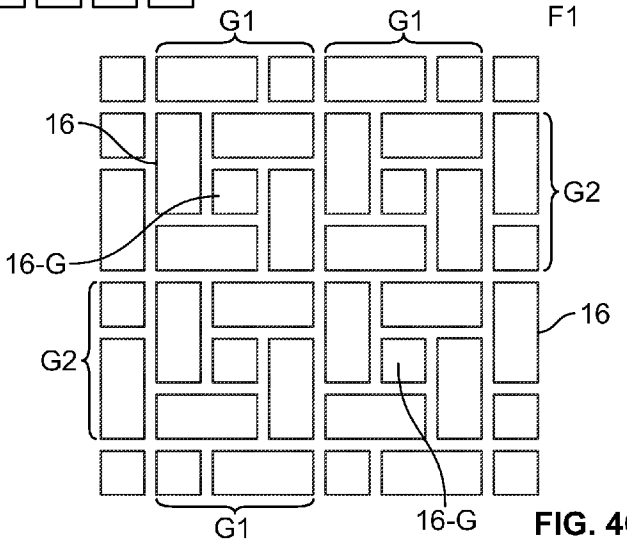

In FIG. 4G paving elements 16 are arranged in a repeating pattern containing five elements. As shown in the square region defined by a column G1, row G2, a central paving element 16-G is surrounded on four sides by four paving elements 16. Paving element 16-G is basically an element that is half the length of paving elements 16. A paving element 16 immediately above element 16-G extends right to left and has its left end aligned with the left edge of element 16-G. A paving element 16 immediately below element 16-G extends right to left and has its right end aligned with the right edge of element 16-G. The other two paving elements 16 are oriented vertically and are placed in the space remaining on the right and left of paving element 16-G.

This Figure has four groups of five (four quints), although practical embodiments will have a larger number of groups. For example, one embodiment may have three columns G1, each with 34 quints. It will be noticed that rotating the pattern of FIG. 4G 90° produces the same pattern. There is therefore no need to discuss extending the pattern in different orthogonal directions. The other elements surrounding the four quints may be considered the remainder after removing two thirds of neighboring quints (the four half-elements in the corners of FIG. 4G being the remainder after removing eight ninths of a quint).

As before, connecting medium 20 of FIG. 3 will be attached between adjacent ones of the paving elements 16 and 16-G so that columns G1 or rows G2 can be wound into a roll similar to that shown in FIG. 5.

Figure 4I:
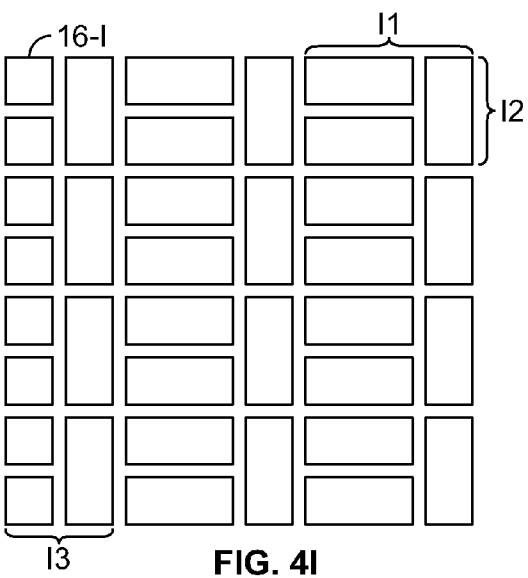
Figure 4H:
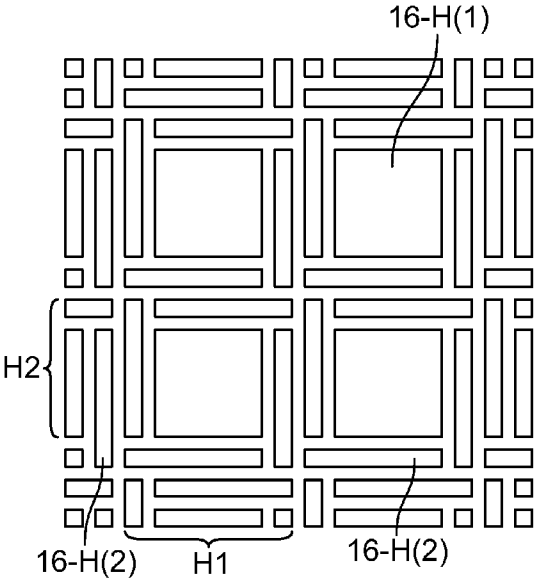

In FIG. 4H square, central paving element 16-H(1) and four surrounding paving elements 16-H(2) are arranged in a repeating pattern of five elements. Central paving element 16-H(1) is similar to previously mentioned paving elements 16 and has the same length but twice the width. Paving elements 16-H(2) are also similar to paving elements 16 but have half the width and 1.5 times the length.

As shown in the square region defined by a column H1, row H2, central paving element 16-H(1) is surrounded on four sides by four paving elements 16-H(2). A paving element 16-H(2) immediately above paving element 16-H(1) extends right to left and has its left end aligned with the left edge of element 16-H(1) A paving element 16-H(2) immediately below element 16-H(1) extends right to left and has its right end aligned with the right edge of element 16-H(1). The other two paving elements 16-H(2) are oriented vertically and are placed in the remaining space on the right and left of paving element 16-H(1).

This Figure has four groups of five (four quints), although practical embodiments will have a larger number of groups. For example, one embodiment may have three columns H1, each with 34 quints. It will be noticed that rotating the pattern of FIG. 4H 90° produces the same pattern. There is therefore no need to discuss extending the pattern in different orthogonal directions. The other elements surrounding the four quints may be considered the remainder after removing portions of neighboring quints.

As before, connecting medium 20 of FIG. 3 will be attached between adjacent ones of the paving elements 16-H (1) and 16-H(2) so that columns H1 or rows H2 can be wound into a roll similar to that shown in FIG. 5.

In FIG. 4I paving elements 16 are arranged in a repeating pattern containing three elements. As shown in the rectangular region defined by column I1, row I2, a pair of parallel paving elements 16, running left to right, are stacked side-by-side and are bordered on the right by a third paving element 16 having its longitudinal axis transverse to the other two. This Figure has two columns I2, each with four trios of paving elements 16, although practical embodiments will have a larger number of trios. For example, one embodiment may have three columns I1 each with 50 trios. Alternatively, another embodiment may have six rows I2 each with 34 columns I1. Row I3 may be considered the remainder after removing the left third of column I1, halved paving elements being identified as elements 16-I.

As before, connecting medium 20 of FIG. 3 will be attached between adjacent ones of the paving elements 16 and 16-I so that columns I1 or rows I2 can be wound into a roll similar to that shown in FIG. 5.

Figure 4J:
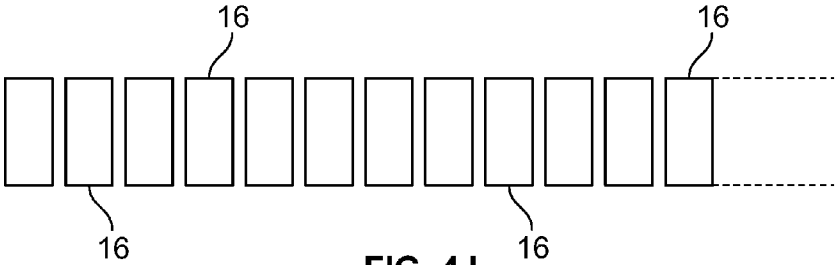

FIG. 4J shows a single row of paving elements 16 with their longitudinal axes parallel. As before, connecting medium 20 of FIG. 3 will be attached between adjacent ones of the paving elements 16 allowing the row to be wound into a roll similar to that shown in FIG. 5. This single row can be used to produce what is commonly referred to as a "soldier row" of pavers.

To facilitate an understanding of the principles associated with the foregoing apparatus, its operation will be briefly described. Referring to FIG. 9 paving elements 16 of previously mentioned roll 21 are shown being installed on an outdoor surface that has been prepared by placing a compacted layer of gravel 10 in a shallow excavation and then covering that layer with a layer of sand 14. This laying of bedding material using granular material was previously described in connection with FIG. 8.

Roll 21 employs the pattern of FIG. 4A, with the columns A1 being wound. Thus FIG. 9 shows the longer side of paving elements 16. A first row of elements 16 are laid in a predetermined region demarcated by edge restraints 12. Because the tops 16A of paving elements 16 face inwardly, roll 21 can rest directly atop surface 14 with the first row of paving element abutting edge restraint 12. Thereafter, the roll 21 can be unwound so that a strip of paving elements 16 are laid atop surface 14 to cover the predetermined region. Roll 21 can be unwound by standing on the paving elements 16 and pushing the roll.

In FIG. 9 a mandrel 50 is placed through the center of roll 21. The mandrel may be a narrow drum with handles, much like an outsized rolling pin. Installers may stand on opposite ends of the mandrel 50 and push it to unwind the roll 21.

The last paving element required (paving element 16(9) of the ninth row) can be severed from roll 21 by cutting connecting medium 21 at the distal end of element 16(9). In this case an entire row of paving elements 16 will be severed from roll 21. The paving elements thus laid on surface 14 are sequestered from the roll 21 and form an interconnected group.

It will be noted that without more, element 16(9) will overlap edge restraint 12'. Accordingly, a circular saw may be used to trim element 16(9) so that it closely abuts edge restraint 12'. In fact, each of the paving elements 16 laid on surface 14 can be trimmed as needed to fit within a relatively complex region.

If the region to be paved is relatively wide, the remainder of roll 21 (or a new roll) can then be moved to lay a second course alongside the first course in the manner just described. In some cases this second course will be a soldier roll from the paving package illustrated in FIG. 4J. All paving elements laid in this manner will be pressed into place by a conventional compacting machine. The joint between successive courses may be interconnected by applying from a tube or caulk gun a sealant made of a material similar to that of connecting medium 20.

Because paving elements 16 are sealed along their upper corners by connecting medium 20, filling the spaces between the paving elements with sand is not necessary or even possible. This elimination of the filling step further increases the efficiency of the paving process.

Figure 8:
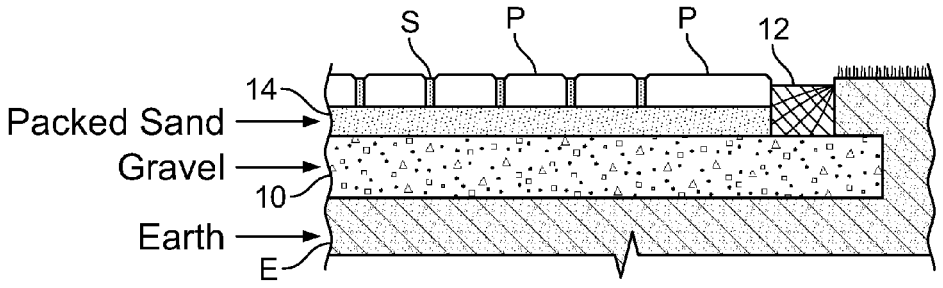
FIG. 8 (Prior Art)
FIG. 8 is an elevational view of paving bricks laid on bedding material in accordance with the prior art.
Figure 9:
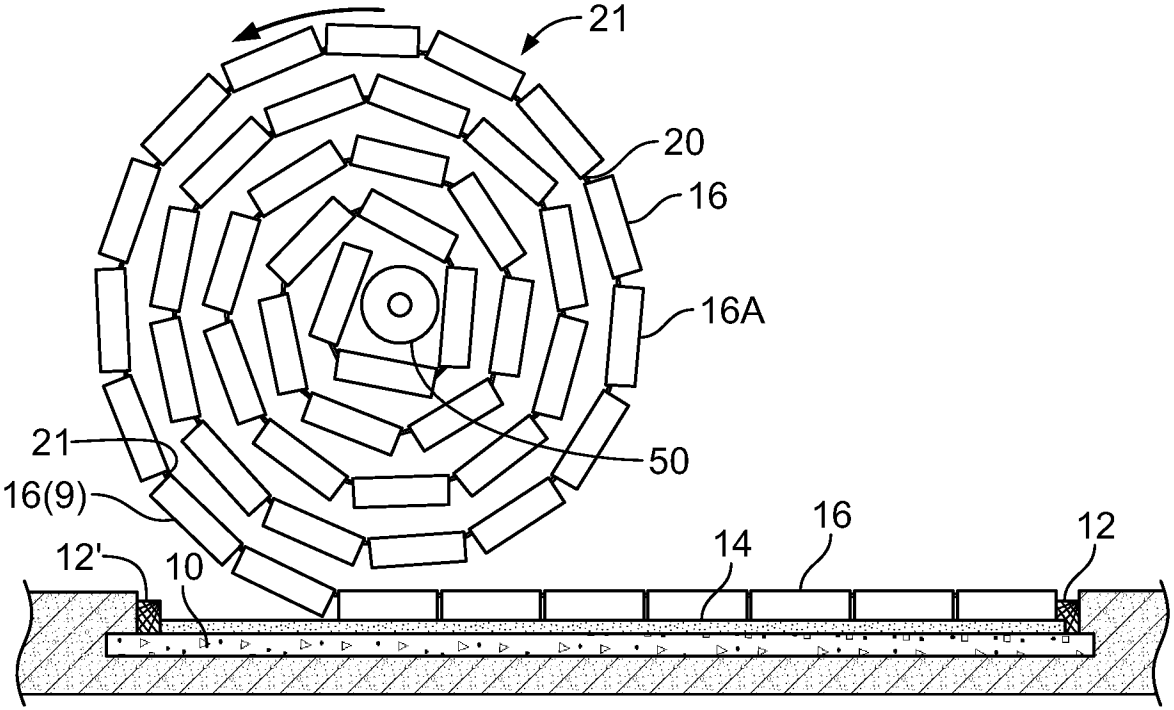
FIG. 9 is an elevational view showing installation with the roll of FIG. 5.
Figure 11:
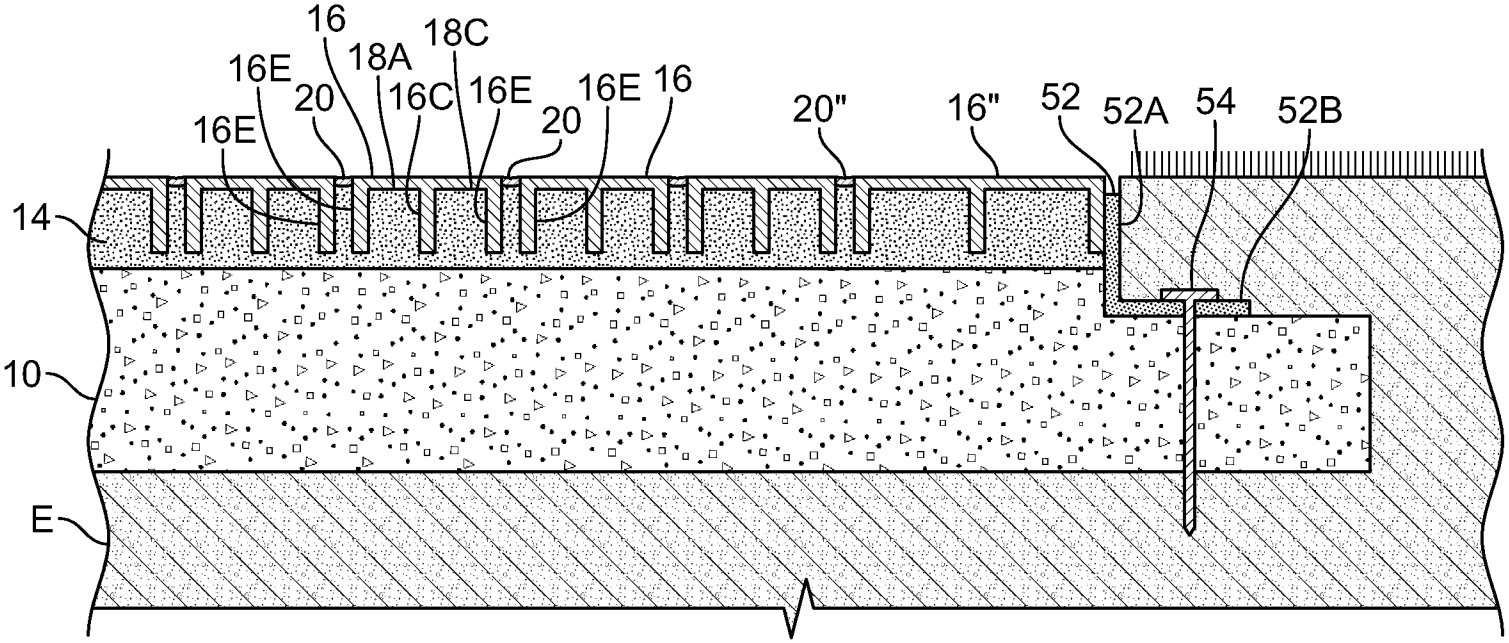
FIG. 11 an elevational, transverse sectional view of the paving elements of FIG. 5 laid on bedding material.

Referring to FIG. 11, a row of paving elements 16 of FIG. 5 are shown in place after being initially laid in the manner shown in FIG. 8. FIG. 11 is a transverse sectional view, that is, a section along a plane parallel to the axis of roll 5 of FIG. 5. Thus, this view may be considered a right to left view, relative to the unwinding direction of roll 21. Again, a compacted gravel layer 10 is covered with a layer of sand 14.

The paving elements 16 have been driven down into sand layer 14 using a conventional compacting machine, as noted above. As a result, sand from layer 14 has entered chambers 18A and 18C (FIG. 1) of the paving elements 16. It will be understood that sand from layer 14 likewise entered chambers 18B and 18D of paving elements 16, but those chambers are not visible in this section. Sand from layer 14 has also entered the space between adjacent ones of the paving elements 16, that is, between neighboring walls 16E and under connecting medium 20.

In this embodiment a soldier row of paving elements as shown in FIG. 4J has been laid along the border of the paved area and has been marked as paving elements 16". The gap between paving elements 16 and element 16" has been joined on top by elastomeric connecting medium 20", which has been laid using a trowel or an appliance similar to a caulking gun.

Paving elements 16" have also been driven into the layer of sand 14 to fill its underlying chambers.

The outside of paving elements 16" are border by an alternate edge restrain 52, which is a plastic extrusion with an L-shaped cross-section. The upright flange 52A of restraint 52 is pressed against the outside of paving elements 16", and is held in place by a series of spikes 54 (only one visible in this view) driven through the lower flange 52B and into gravel layer 10.

Figure 6:
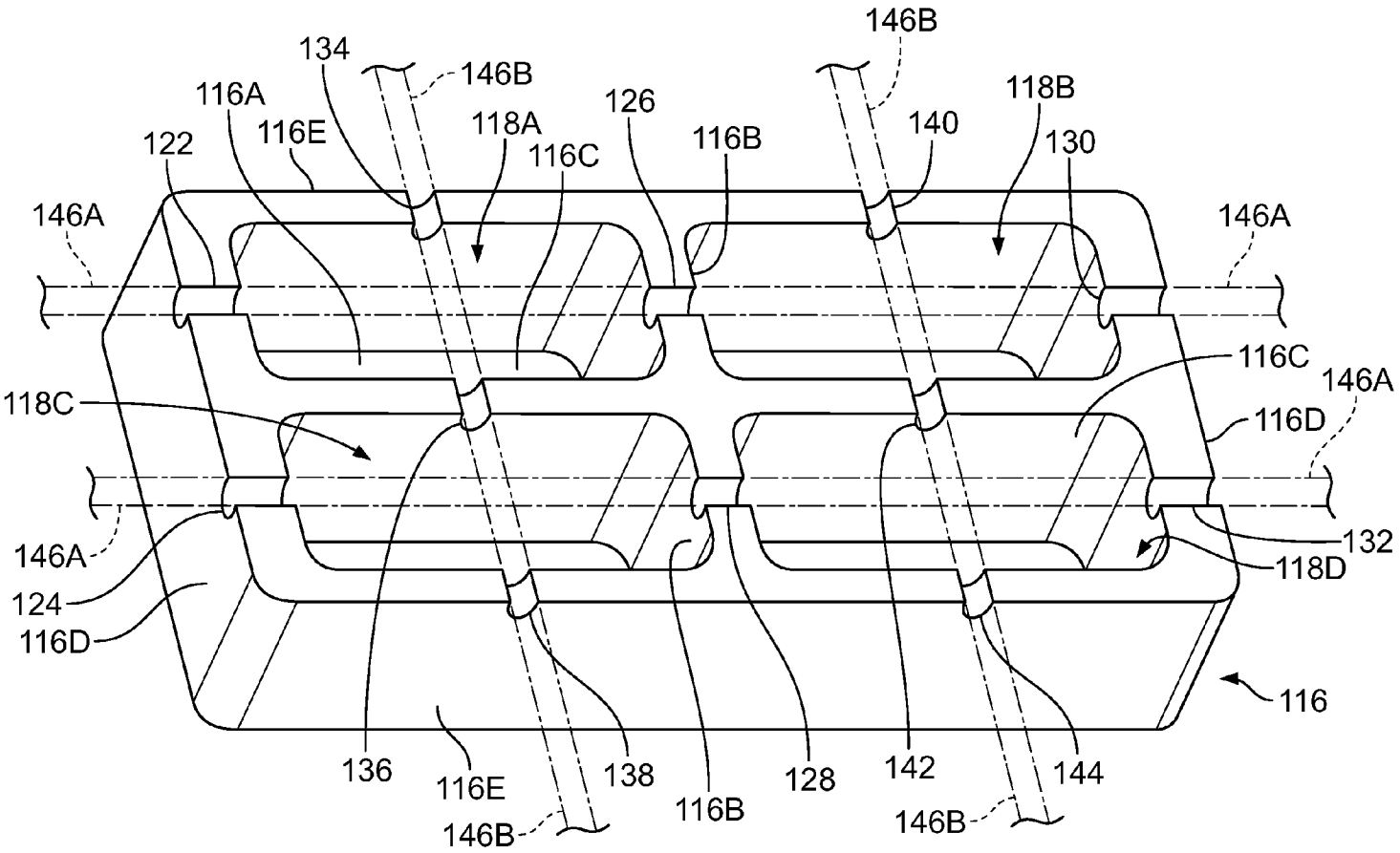
FIG. 6 is a perspective view of a paving element that is an alternate to that of FIG. 3 with an interconnecting grid shown in phantom.

Referring to FIG. 6 paving element 116 is the same as shown in FIG. 1 (or the same as the variations described in connection with paving element 16). This embodiment however is modified to include subjacent notches 122, 124, 126, 128, 130, 132, 134, 136, 138, 140, 142, and 144. Notches 122, 124, 130, and 132 cut across walls 116D into chambers 118A 118C, 118B and 118D, respectively. Notch 126 cuts across wall 116B between chambers 118A and 118B. Notch 128 cuts across wall 116B between chambers 118C and 118D. Notches 134, 140, 138 and 144 cut across walls 116E into chambers 118A 118B, 118C and 118D, respectively. Notch 136 cuts across wall 116C between chambers 118A and 118C. Notch 142 cuts across wall 116C between chambers 118B and 118D.

A pair of elastic cords 146A is shown lying in some of these notches, one cord lying in notches 122, 126, 130, and the other cord lying in notches 124, 128, and 132. Another pair of elastic cords 146B is shown lying in some of these notches, one cord lying in notches 134, 136, and 138 and the other cord lying in notches 140, 142, and 144. Cords 146A and 146B cross perpendicularly and may be either joined or not joined at these crossings. Cords 146A and 146B may be secured in place by adhesives, discrete fasteners, etc. Cords 146A and 146B are also secured in notches in adjacent paving elements that are the same as element 116. Accordingly, cords 146A and 146B (collectively cords 146) form a flexible grid or mesh that acts as a connecting medium.

Figure 7:
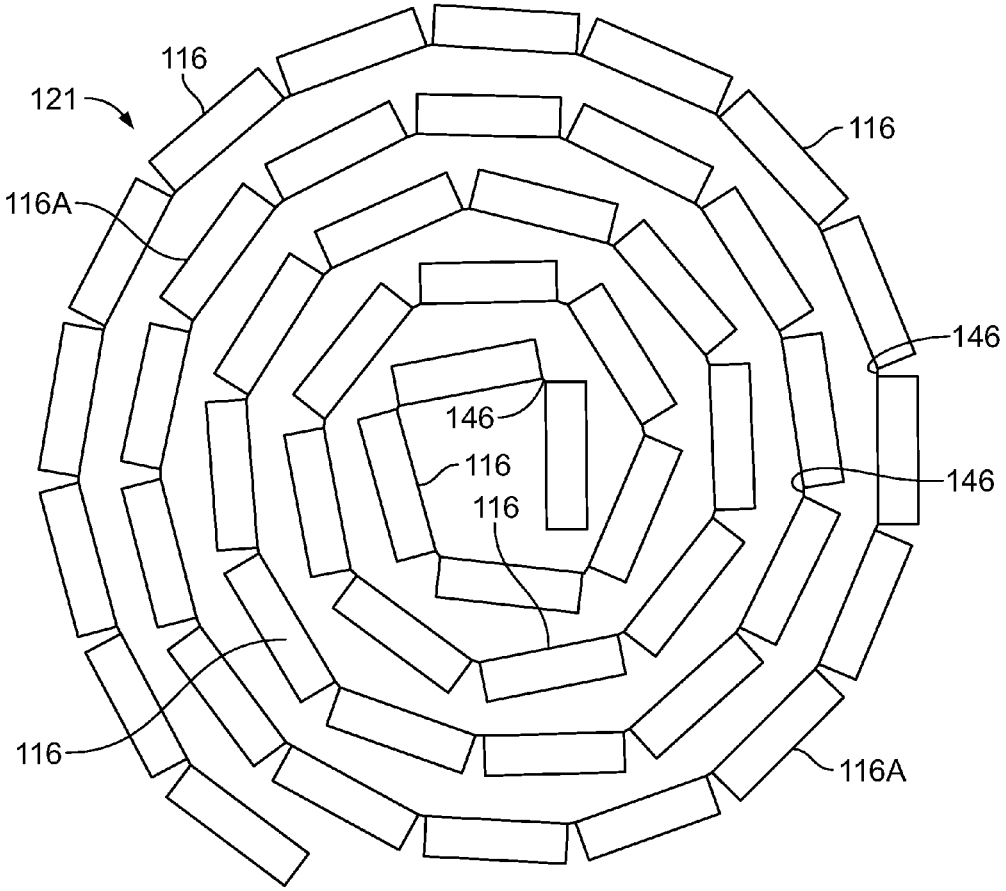
FIG. 7 is an axial view showing the paving elements interconnected with the connecting medium of FIG. 6 into the pattern of FIG. 4A, and wound into a roll.

Accordingly, paving elements 116 can be formed into any of the patterns shown in FIGS. 4A through 4J. Also, paving elements 116 arranged in the pattern of FIG. 4A with their columns wound into a paving package 121 as shown in FIG. 7.

Figure 10:
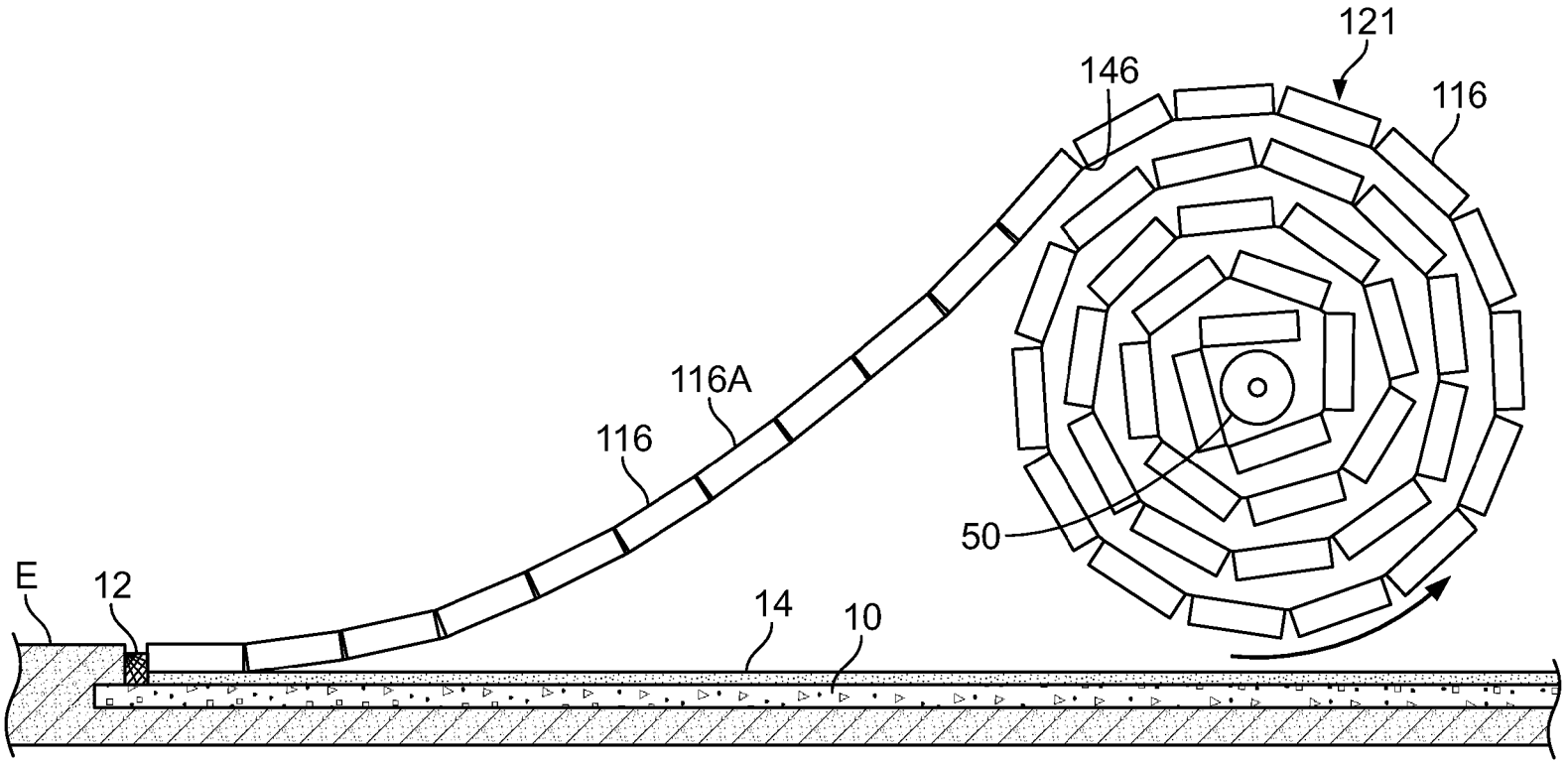
FIG. 10 is an elevational view showing installation with the roll of FIG. 7.

As shown in FIG. 10, elements 116 can be installed on the outdoor surface 14, which is a layer of sand lying on a layer of compacted gravel 10 in a shallow excavation. Because the tops 116A of paving elements 116 face radially outward, roll 121 must be held at a higher elevation than surface 14. Previously mentioned mandrel 50 will facilitate lifting of roll 121. Manually lifting roll 121 is feasible because paving elements 116 are made of relatively light composite material and have hollow chambers.

The first row of paving elements 116 is placed against edge restraint 12 and may be kept in position by standing on it or by placing a heavy weight on it. Thereafter a strip of paving elements 116 can be pulled off the roll 121 as the installers carry a roll down along the region to be paved. Paving elements 116 can be trimmed as required in the manner previously described.

Because connecting medium 146 is located subjacently, the installer should now sweep sand into the spaces between adjacent paving elements 116, to fill them with particulate material in the usual manner.

Obviously, many modifications and variations of the present invention are possible in light of the above teachings. It is therefore to be understood that within the scope of the appended claims, the invention may be practiced otherwise than as specifically described.

The invention claimed is:

1. A method of packaging paving elements with a connecting medium, comprising the steps of:

affixing the paving elements to said connecting medium to form a strip having a pattern with a plurality of the paving elements; and winding said paving elements and said connecting medium into a roll that increases separation between at least some of the paving elements without decreasing the clearance between them, said paving elements each have a plurality of side faces, the step of interconnecting the paving elements being performed by adhering said connecting medium between adjacent ones of the plurality of side faces, the step of adhering being performed by adhering the connecting medium along an upper portion of the adjacent ones of the plurality of side faces.

2. A method according to claim 1 wherein the step of adhering the connecting medium is performed by vulcanization.

3. A paving package comprising:

a flexible connecting medium; and a spaced plurality of paving elements interconnected through said connecting medium to form a strip having a pattern with a plurality of the paving elements, said paving elements and said connecting medium being wound together into a roll that increases separation between at least some of the paving elements without decreasing the clearance between them, said plurality of paving elements each having a plurality of side faces, said connecting medium being adhered between adjacent ones of the plurality of side faces, said plurality of side faces each have an upper edge, said connecting medium being located along the upper edge of adjacent ones of the plurality of side faces.

4. A paving package according to claim 3 wherein said plurality of paving elements each comprise a composite material.

5. A paving package according to claim 4 wherein said plurality of paving elements each have an underside with at least one concavity.

6. A paving package according to claim 4 wherein said plurality of paving elements each have an underside with a plurality of concavities.

7. A paving package according to claim 3 wherein said plurality of paving elements each comprise a composite material having an underside with a plurality of concavities.

8. A paving package according to claim 3 wherein said connecting medium comprises a vulcanized material.

* * * * *